US007255567B1

(12) United States Patent
Liao

(10) Patent No.: US 7,255,567 B1
(45) Date of Patent: Aug. 14, 2007

(54) PIVOTING ADAPTER STRUCTURE FOR ASSEMBLING PLUGS

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 11/432,531

(22) Filed: May 12, 2006

(30) Foreign Application Priority Data

Feb. 21, 2006 (TW) ..... 95105793 A

(51) Int. Cl.
*H01R 39/00* (2006.01)

(52) U.S. Cl. ..... 439/11; 439/638; 439/640; 439/218

(58) Field of Classification Search ..... 439/11, 439/676, 638, 640, 217, 218
See application file for complete search history.

(56) References Cited

U.S. PATENT DOCUMENTS 4,997,381 A * 3/1991 Oh ..... 439/172
6,213,782 B1 * 4/2001 Derstine ..... 439/31
6,786,734 B2 * 9/2004 Yu ..... 439/11
6,907,615 B1 * 6/2005 Alexander et al. ..... 725/80
6,981,895 B2 * 1/2006 Potega ..... 439/578
2006/0009083 A1 1/2006 Liao

FOREIGN PATENT DOCUMENTS

TW M288031 2/2006

* cited by examiner

*Primary Examiner*—Tho D. Ta
*Assistant Examiner*—Vanessa Girardi
(74) *Attorney, Agent, or Firm*—Rosenberg, Klein & Lee

(57) ABSTRACT

A composite simple plug comprises an insulation case, a plurality of terminals, a connector, and a plug of a network line or a plug of a phone line. The insulation case has a trough. The terminals are set in the insulation case and appeared on the trough. The connector is set in the front of the insulation case. The connector is connected electrically to the terminals. Make use of this, the insulation case can be applied to switch all kinds of plugs. The composite simple plug can connect with a plug of a network line or a connecting unit to connect with all kinds of plugs of a phone line. It makes the plug of a phone line be switched to the plug of a network line. The composite simple plug provides a function of simply switching and it is more convenient for using.

10 Claims, 7 Drawing Sheets

PIVOTING ADAPTER STRUCTURE FOR ASSEMBLING PLUGS

BACKGROUND OF THE INVENTION

1. Field of the Invention

The present invention relates to a composite simple plug, and in particular to a structure for connecting with a connector and a plug of a network line or a phone line, changing into all kinds of connectors according to the request, and switching to the plug of a network line or a phone line.

2. Description of Prior Art

The conventional switching plug can provide a function of switching two kinds of plugs according to request, for example, switching a plug of a phone line to a plug of a network line.

Taiwan Patent Application No. 94217851 (or its U.S. counterpart, U.S. patent application Ser. No. 10/967,243), entitled "Simple Switching Plug Structure" previously filed by the inventor of the present invention, discloses an insulation body, several terminals and a switching member. The insulation body has several terminal troughs. Terminals are provided in the terminal troughs, respectively. The switching member is pivotably connected on the insulation body to adjust its rotation according to the request. Although this patent document achieves to switch different kinds of plugs, namely, switch a plug of a phone line to a plug of a network line by the switching member, there is still some insufficiency in use.

Therefore, in view of the above drawbacks, the inventor proposes the present invention to efficiently overcome the drawbacks of prior art based on his deliberate researches and expert experiences.

SUMMARY OF THE INVENTION

The object of the present invention is to provide a composite simple plug for adapting the insulation case to all kinds of plugs.

Another object of the present invention is to allow the insulation case serving as an adapter to connect with a plug of a network line or a plug of a phone line to switch to all kinds of plugs. A connecting unit is used to switch a plug of a network line to a plug of a phone line, or switch a plug of a phone line to a plug of a network line. The connecting unit is connected between the insulation case and the plug of the phone line, and further is formed into a composite simple plug structure. With the above arrangement, the present invention is simple in structure, small in size, less in cost, convenient for carrying and easy to switch to all kinds of plugs.

In order to achieve the above object, the present invention provides a composite simple plug comprising an insulation case provided with a trough, a plurality of terminals and a connector. The terminals are provided in the insulation case. One end of each terminal appears on the trough. The connector is provided in the front end of the insulation case and is electrically connected to the other end of the terminals.

The trough of the present invention is movably pivoted to a plug of a network line. The plug of the network line is electrically connected with the terminals. Alternatively, the trough is further movably pivoted to a connecting unit. A plug of a phone line is pivoted to the inside of the connecting unit. The plug of the phone line is electrically connected with the terminals.

In order to further understanding the technique, method and effect utilized by the present invention, the detailed description and the technical contents of the preferred embodiments of the present invention will be explained with reference to the accompanying drawings. However, it should be understood that the drawings and the description are illustrative but not used to limit the scope of the present invention.

DETAILED DESCRIPTION OF THE INVENTION

Figure 1:
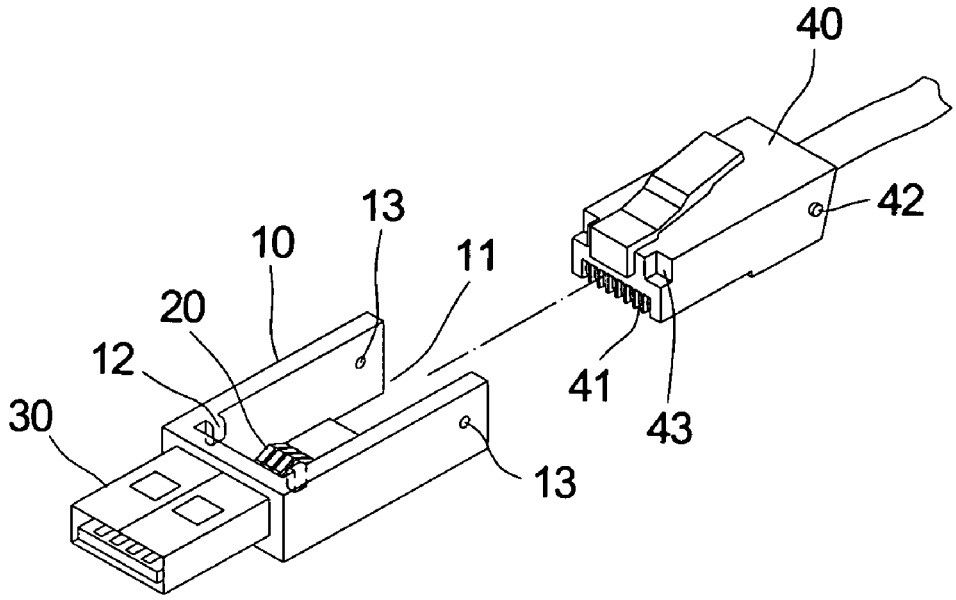
FIG. 1 is an exploded perspective view showing a connector of a first embodiment of the present invention connected to a plug of a network line.

With reference to FIGS. 1 to 4, the present invention provides a composite simple plug comprising an insulation case 10, a plurality of terminals 20 and a connector 30. The insulation case 10 is made of insulating materials, such as plastics. One side of the insulation case 10 is provided with a trough 11. The rear end of the trough 11 can be hollowed out. The wall face of the trough 11 is further provided with a pair of latching portions 12 and a pair of first pivoting portions 13 corresponding to each other. Both latching portions 12 protrude on the left and right wall face of the trough 11, respectively, and provided adjacent to the front end of the trough 11. The end face of the latching portion 12 is curved. Both first pivoting portions 13 are provided on the left and right wall faces of the trough 11, respectively, and provided adjacent to the rear end of the trough 11. The first pivoting portion 13 can be a circular hole or a cylinder.

Figure 2:
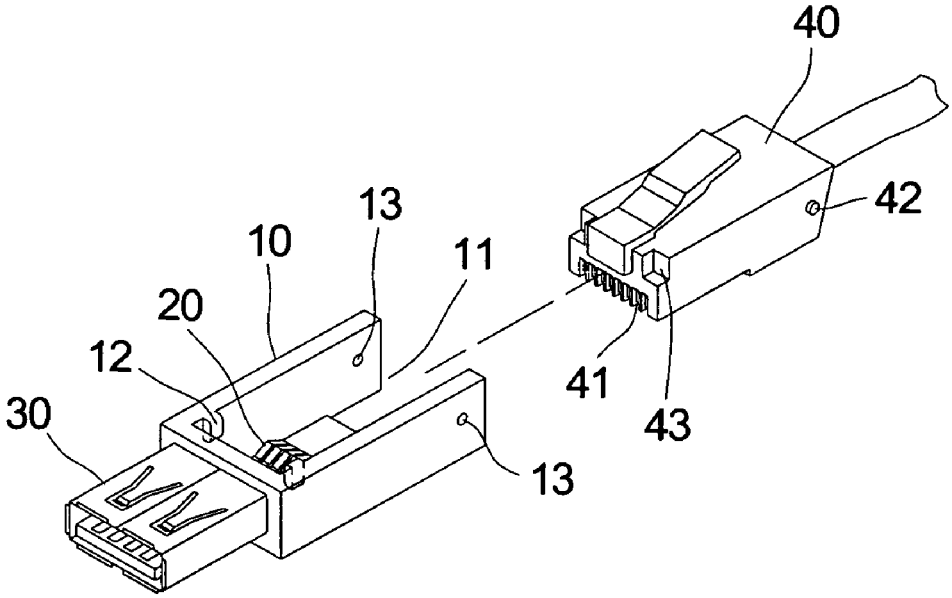
FIG. 2 is an exploded perspective view showing a connector of a second embodiment of the present invention connected to a plug of a network line.
Figure 3:
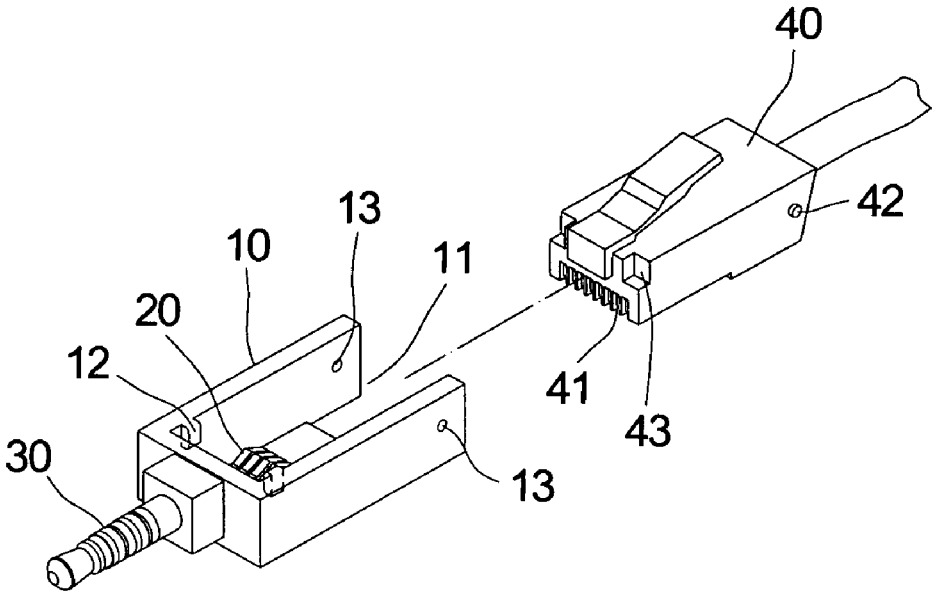
FIG. 3 is an exploded perspective view showing a connector of a third embodiment of the present invention connected to a plug of a network line.
Figure 4:
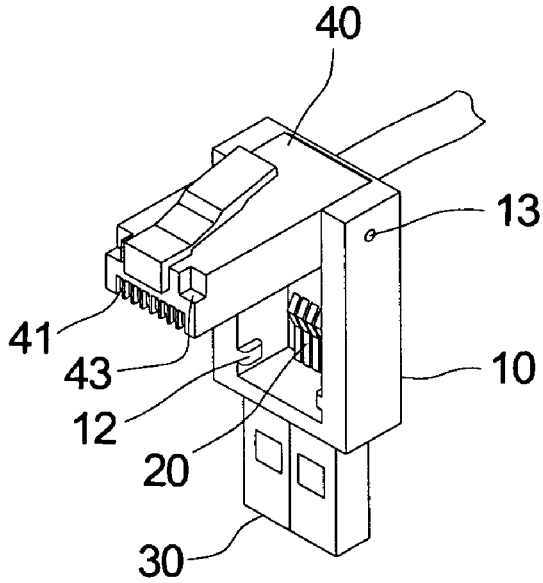
FIG. 4 is a schematic view showing the assembled state in which the present invention is connected to a plug of a network line.
Figure 5:
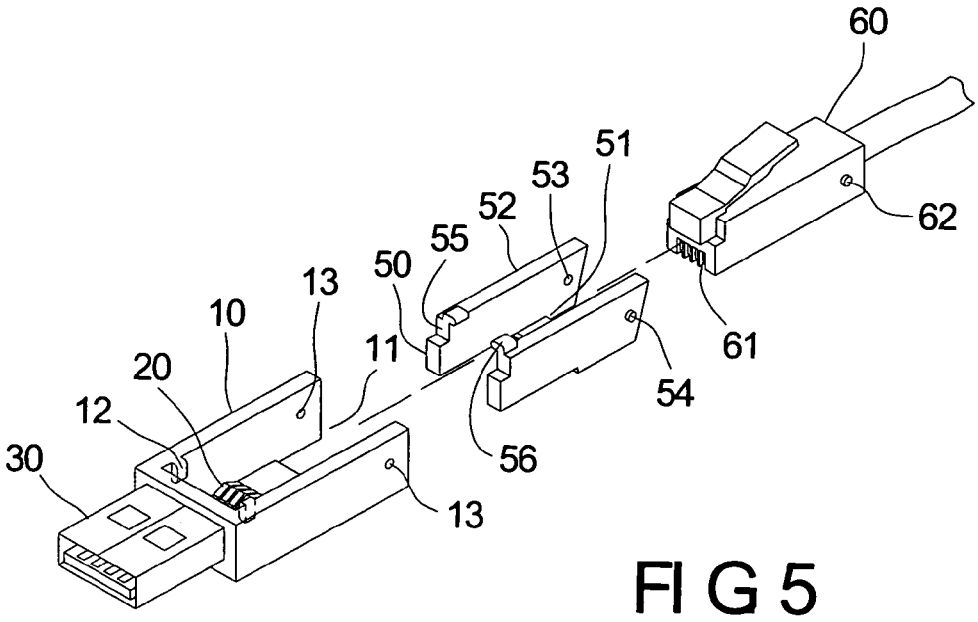
FIG. 5 is an exploded perspective view showing that the present invention is connected to a connecting unit and a plug of a phone line.
Figure 6:
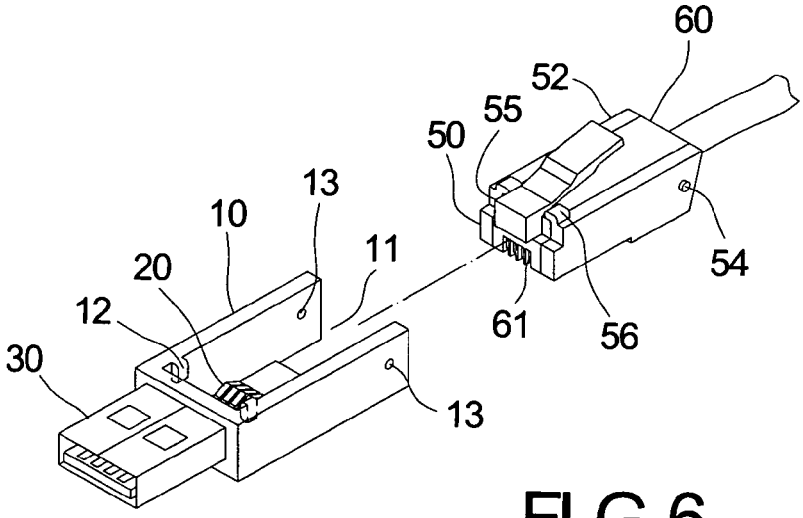
FIG. 6 is a perspective view showing the assembled state in which the connecting unit of the present invention is connected to a plug of a phone line.
Figure 7:
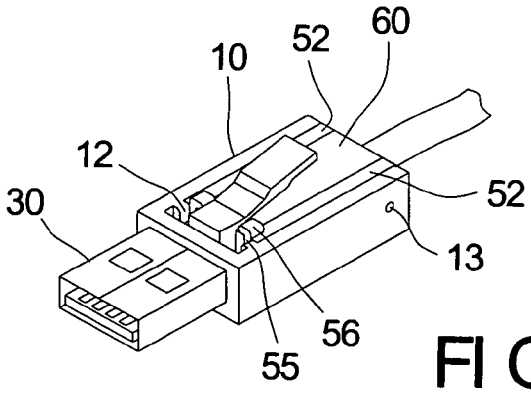
FIG. 7 is a perspective view showing the assembled state in which the connecting unit of the present invention is connected to an insulation case.
Figure 8:
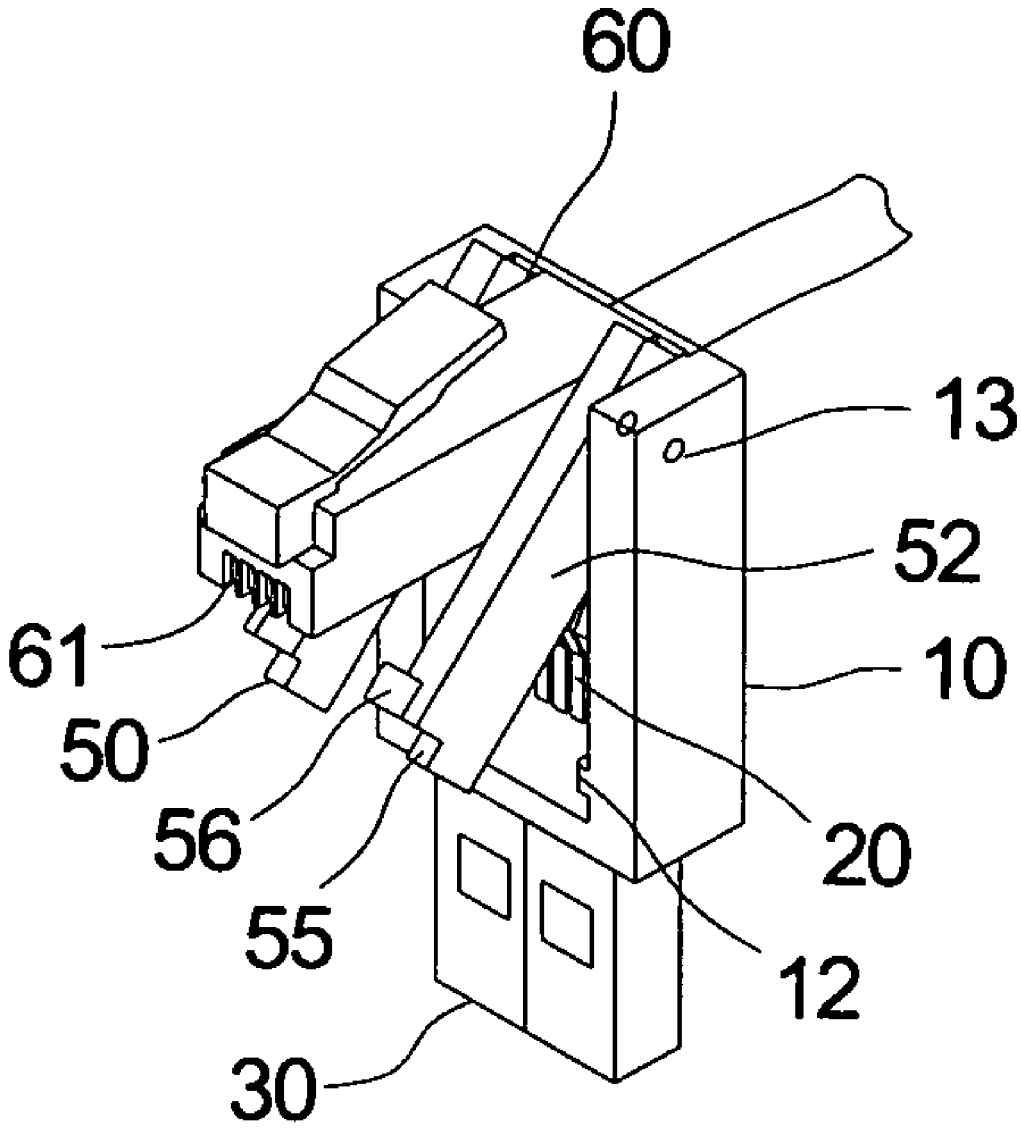
FIG. 8 is a schematic view showing the assembled state in which the present invention is connected to a plug of a phone line and the connecting unit.

The terminals 20 are made of conductive materials, such as copper. The number of the terminals is not limited and these terminals are equidistantly provided in the insulating case 10. One end of each terminal 20 is bent and appears on the trough 11. The connector 30 is provided in the front end of the insulation case 10 and electrically connected to the other end of each terminal 20. The connector 30 can be a USB of male type (as shown in FIG. 1) or female type (as shown in FIG. 2). Alternatively, the connector 30 can be an audio signal terminal (as shown in FIG. 3). With the above arrangement, the insulation case 10 of the present invention functions as an adapter via the terminals 20 and the connector 30.

In the present invention, the terminals 20 and the connector 30 are provided on the insulation case 10. The trough 11 can be movably pivoted to an 8-pin plug 40 of a network line. The terminals 41 on the plug 40 of the network line are electrically connected to the terminals 20 on the insulation case 10. The plug 40 of the network line can be further provided with two second pivoting portions 42. The two second pivoting portions 42 are provided on both sides of the plug 40 of the network line 40, respectively. The second pivoting portion 42 can be a cylinder or circular hole. The second pivoting portion 42 of the plug 40 of the network line can be movably pivoted to the first pivoting portion 13 of the insulation case 10, so that the plug 40 of the network line can be movably pivoted on the trough 11 of the insulation case 10. Both sides of the front end of the plug 40 of the network line are provided with a notch 43, respectively. Each notch 43 of the plug 40 of the network line abuts against the latching portion 12 of the trough 11, so that the plug 40 of the network line can be movably fixed on the trough 11 of the insulation case 10, thereby avoiding the plug 40 of the network line from swaying.

Therefore, the present invention utilizes the insulation case 10 to connect to the plug 40 of the network line and the connector 30, so that the insulation case 10 can be directly switched to two kinds of plugs. The plug 40 of the network line can be switched to the connector 30 (such as USB) and thus inserted into an electronic information product, such as a notebook or a desktop computer, allowing the manufacturers of the electronic information products to simplify the necessary members of a socket of the network line. Further, the thickness of the electronic information product can be reduced to achieve a small weight and compact size. Also, when the user goes out, it is convenient to carry the present invention without occupying too much space. Further, the present invention can be easily connected to the plug 40 of the network line at any time without any other associated transmission line.

Further, as shown in FIGS. 5 to 8, since the 8-pin plug 40 of the network line and the 4-pin plug 60 of the phone line are different in size, the trough 11 of the insulation case 10 can be further movably pivoted to a connecting unit 50. The connecting unit 50 has a support 51 and side arms 52 on left and right sides. The inner edge of each side arm 52 is provided with a third pivoting portion 53 adjacent to the rear end and corresponding to each other. The third pivoting portion may be a circular hole or a cylinder. The outer edge of each side arm 52 is provided with a fourth pivoting portion 54 adjacent to the rear end and corresponding to each other. The fourth pivoting portion may be a circular hole or a cylinder. Both third pivoting portions 53 mutually correspond to the fourth pivoting portions 54. The front end of the plug 60 of the phone line has terminals 61. Each side of the plug 60 is provided with a fifth pivoting portion 62 adjacent to the rear end and corresponding to each other. The fifth pivoting portion may be a circular hole or a cylinder. The front end of the each side arm 52 is provided with a notch 55. The top of each side arm 52 can be further provided with a curved fixing portion 56. With the third pivoting portion 53, the connecting unit 50 can be movably pivoted to the fifth pivoting portion 62 of the plug 60 of the phone line. The fourth pivoting portion 54 of the connecting unit 50 can be movably pivoted to the first pivoting portion 13 of the trough 11, so that the connecting unit 50 and the plug 60 of the phone line can be movably pivoted on the trough 11 of the insulation case 10. The notch 55 of each side arm 52 abuts against the latching portion 12 of the trough 11, thereby achieving the electrical connection between the terminals 61 of the plug 60 of the phone line and the terminals 20 of the insulation case 10. As a result, the present invention can be adapted to different kinds of plugs (such as the plug 40 of the network line or the plug 60 of the phone line). When the plug 60 of the phone line is pivoted into the connecting unit 50, the two fixing portion 56 are used to fix the top ends of the plug 60 of the phone line, thereby avoiding the plug 60 of the phone line from swaying.

Alternatively, the connecting unit 50 can be only provided with two side arms 52. The two side arms 52 are simultaneously pivoted to the plug 40 of the network line and the insulation case 10, thereby providing the same effect.

Figure 9:
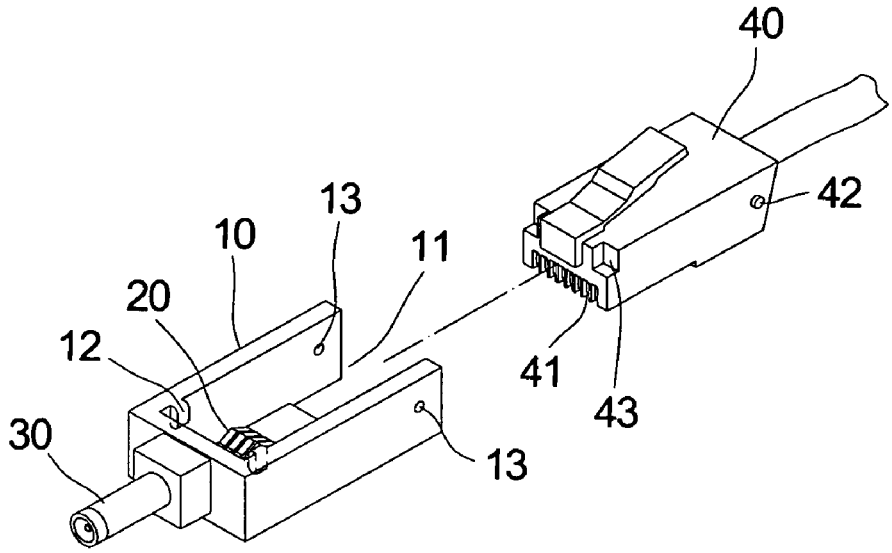
FIG. 9 is an exploded perspective view showing a connector of a fourth embodiment of the present invention connected to a plug of a network line.
Figure 10:
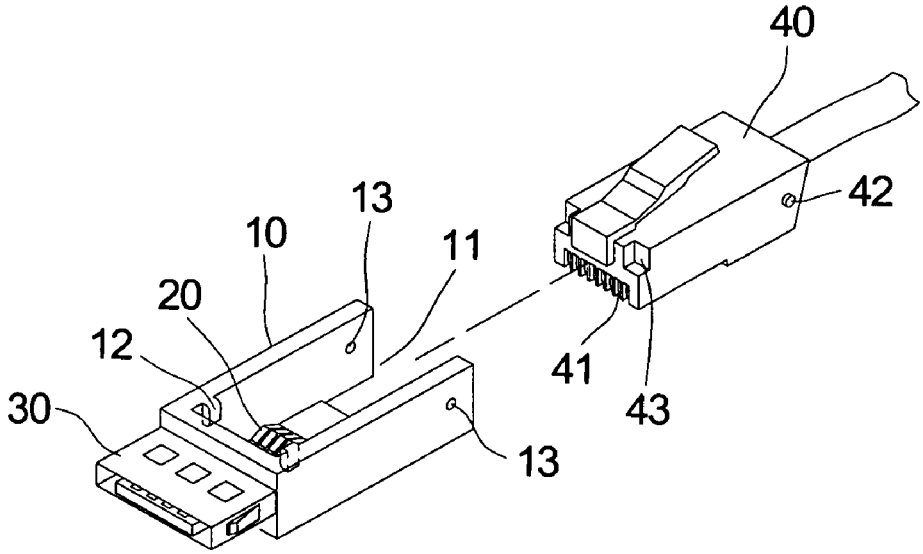
FIG. 10 is an exploded perspective view showing a connector of a fifth embodiment of the present invention connected to a plug of a network line.
Figure 11:
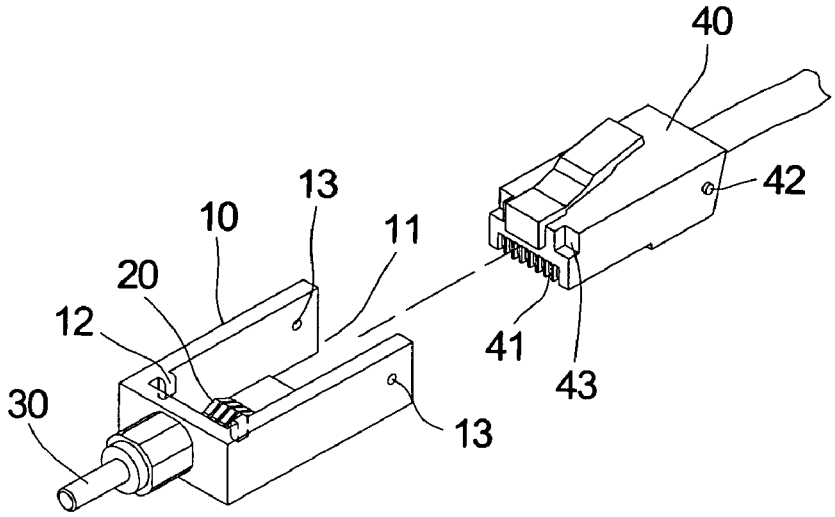
FIG. 11 is an exploded perspective view showing a connector of a sixth embodiment of the present invention connected to a plug of a network line.

Further, as shown in FIG. 9, the connector 30 can be also a DC plug of male type or female type (not shown). Alternatively, as shown in FIG. 10, the connector 30 can be a connector for a portable electronic product, such as mobile phone or PDA. Further, as shown in FIG. 11, the connector 30 can be also a video signal terminal.

Figure 12:
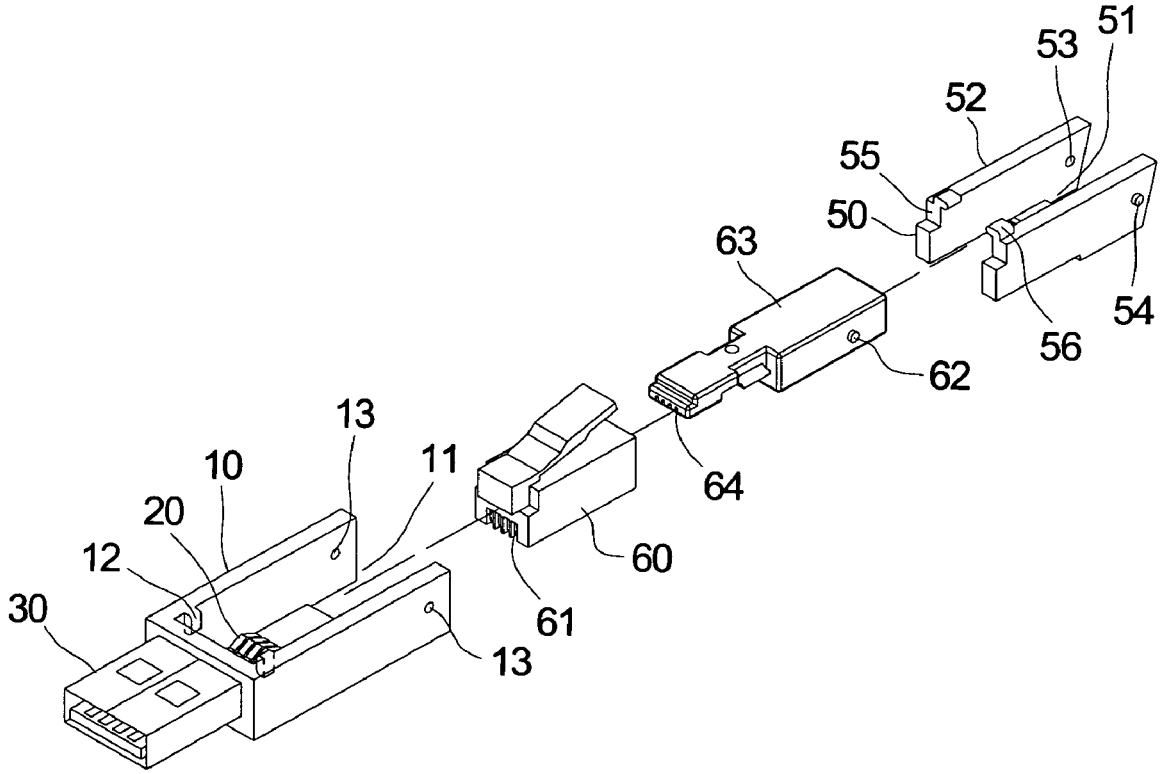
FIG. 12 is an exploded perspective view showing that the connector of the present invention is connected to a plug of a phone line.

Alternatively, as shown in FIG. 12, in the present invention, the shape and structure of the plug 60 of the phone line can be modified in various ways. The present embodiment is further provided with a connector 63 made of insulating materials (such as plastics). The connector 63 allows the leads (not shown) of the plug 60 of the phone line to penetrate into its interior. The front portion of the connector 63 is provided with several line grooves 64. Those leads are inserted and arranged into the interior of the line grooves 64 through the rear end of the connector 63. The leads are previously connected to the connector 63, and then the connector 63 is inserted into the rear end of the plug 60 of the phone line. With the connector 63, the leads can be guided into the front end within the plug 60 of the phone line, so that the connector 63 can be engaged and fixed within the plug 60 of the phone line. The connector 63 and the plug 60 of the phone line are combined with each other to form one piece, so that the electrical connection between the terminals 61 of the plug 60 of the phone line and the conductors within the leads can be achieved. Both fifth pivoting portions 62 are provided on left and right sides of the connector 63. The third pivoting portion 53 of the connecting unit 50 can be movably pivoted on the fifth pivoting portion 62 of the connector 63.

Figure 13:
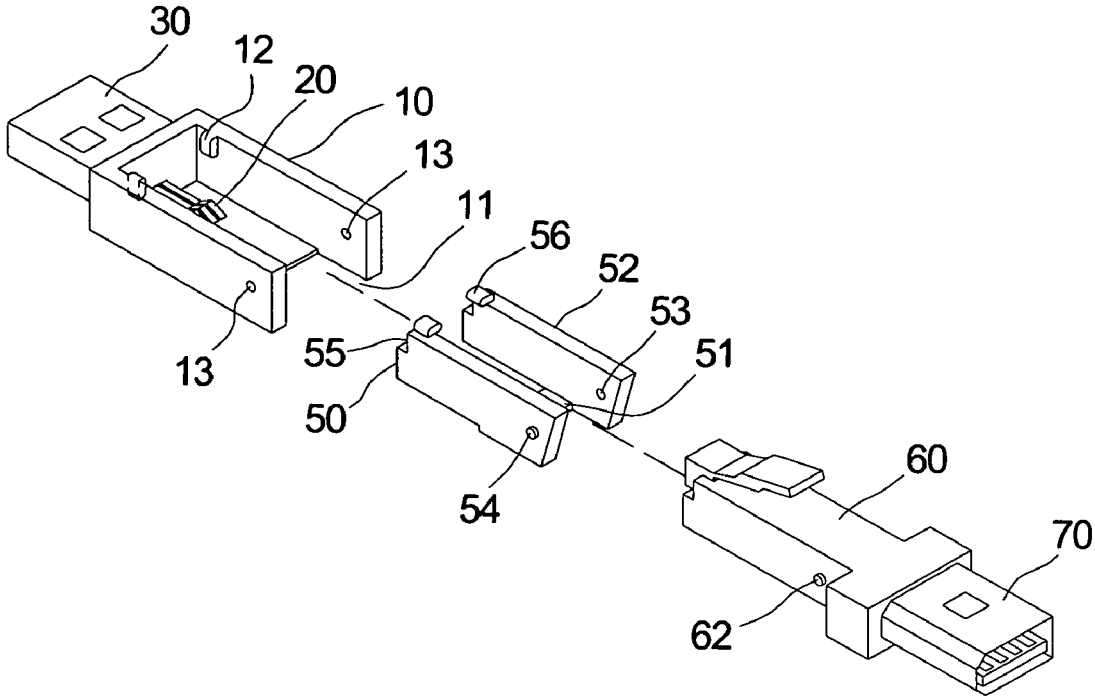
FIG. 13 is a schematic perspective view of a first embodiment in which the second connector of the present invention is connected to a plug of a phone line.
Figure 14:
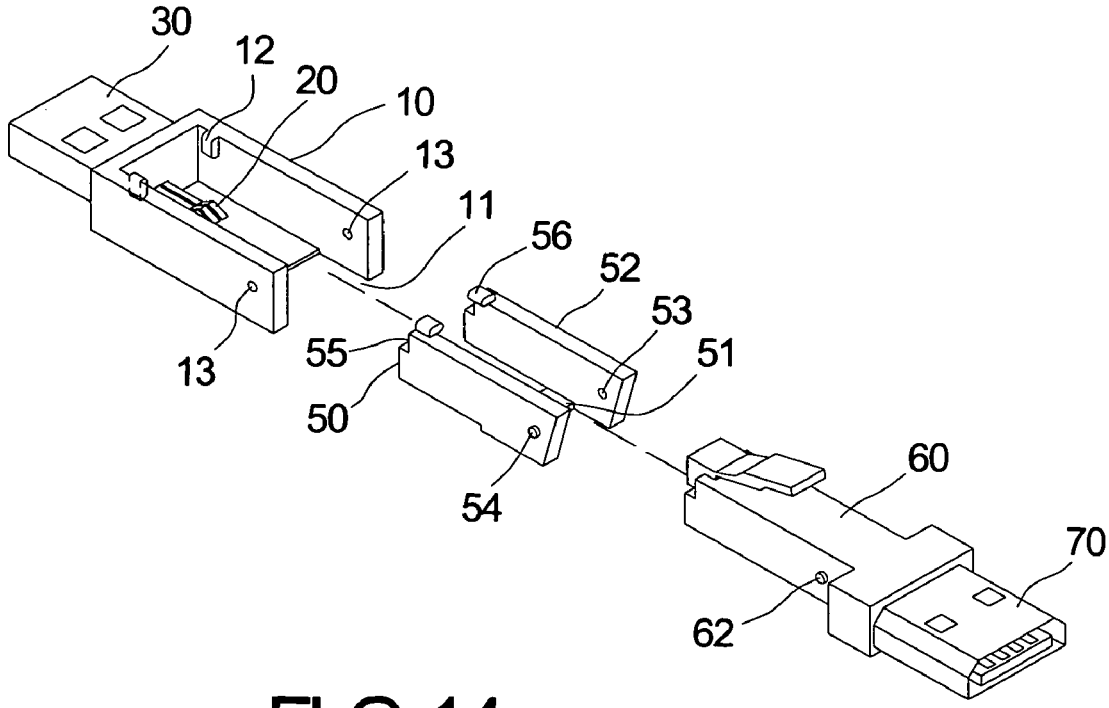
FIG. 14 is a schematic perspective view of a second embodiment in which the second connector of the present invention is connected to a plug of a phone line.

Further, as shown in FIG. 13, in the present invention, the rear end of the plug 60 of the phone line can be also connected with a second connector 70. The terminals (not shown) of the plug 60 of the phone line are electrically connected to the terminals (not shown) of the second connector 70, so that the second connector can be formed into an adapter. The second connector 70 can be an IEEI1394 connector. Alternatively, as shown in FIG. 14, the second connector 70 also can be a HDMI (High-Definition Multimedia Interface) connector.

According to the above, the insulation case 10 of the present invention can be connected to the plug 40 of the network line so as to switch to two kinds of plugs. With its ingenious structure, different kinds of connector 30 can be changed according to the request and thus the present invention functions as an adapter. Further, with the connecting unit 50, the plug 40 of the network line can be changed to different kinds of plugs 60 of the phone line, so that the plug 60 of the phone line can be switched to the plug 40 of the network line. With the simple switch of the connecting unit 50, the insulation case 10 can be simultaneously applied to different kinds of plugs 40 of the network line or the plugs 60 of the phone line. Therefore, the present invention is simple in structure, easy to manufacture, small in size, less in cost, convenient to carry, and easy to switch to all kinds of plugs.

Although the present invention has been described with reference to the foregoing preferred embodiments, it will be understood that the invention is not limited to the details thereof. Various equivalent variations and modifications can still be occurred to those skilled in this art in view of the teachings of the present invention. Thus, all such variations and equivalent modifications are also embraced within the scope of the invention as defined in the appended claims.

What is claimed is:

1. A pivoting adapter structure for assembling plugs, comprising:

an insulation case having a trough;

a plurality of terminals disposed in the insulation case, one end of each terminal being disposed in the trough;

a connector disposed on a front end of the insulation case and electrically connected with the other end of the plurality of terminals; and a plug of a network line releasably coupled to the trough and electrically connected with the plurality of terminals, the plug of the network line being pivotally coupled to the trough;

wherein a wall face of the trough is formed with a pair of first pivoting portions corresponding to each other the plug of the network line being formed with two second pivoting portions movably pivoted to the first pivoting portions of the insulation case, the plug of the network line being movably pivoted in the trough of the insulation case and being releasably separable therefrom to thereby allow the plug to be assembled to a predetermined connector disposed on the insulation case, wherein when the plug is pivoted the terminals of the plug are removed from contact with the terminals of the connector in the trough and the electrical connection of the plug with the connector is broken.

2. The pivoting adapter structure according to claim 1, wherein the wall face of the trough is further provided with a pair of latching portions corresponding to each other, each side of the front end of the plug of the network line is provided with a notch for abutting against the latching portion of the trough.

3. The pivoting adapter structure according to claim 1, wherein the connector is one of a USB connector, an audio signal terminal connector, a DC plug, a connector for portable electronic products or a video signal terminal connector.

4. A pivoting adapter structure for assembling plugs, comprising:

an insulation case having a trough;

a plurality of terminals disposed in the insulation case, one end of each terminal being disposed in the trough;

a connector disposed on a front end of the insulation case and electrically connected with the other end of the plurality of terminals;

a connecting unit movably pivoted in the trough; and a plug of a phone line movably pivoted to the connecting unit and electrically connected with the plurality of terminals;

wherein the connecting unit has a support and two side arms on two sides thereof, or the connecting unit has two side arms, and an inside of the two side arms is pivoted to the plug of the phone line, and each side arm is provided with a fixing portion for fixing the plug of a phone line in place.

5. The pivoting adapter structure according to claim 4, wherein the wall face of the trough is further provided with a pair of first pivoting portions corresponding to each other, an inner edge of the side arms is provided with a pair of third pivoting portions corresponding to each other, an outer edge of the two side arms is provided with a pair of fourth pivoting portions corresponding to each other, each side of the plug of the phone line is provided with a fifth pivoting portion corresponding to each other, the third pivoting portions of the connecting unit are movably pivoted to the fifth pivoting portions of the plug of the phone line, the fourth pivoting portions of the connecting unit is movably pivoted to the first pivoting portions of the trough, and the connecting unit and the plug of the phone line are movably pivoted on the trough of the insulation case.

6. The pivoting adapter structure according to claim 4, wherein the wall face of the trough is further provided with a pair of latching portions corresponding to each other, and a front end of each side arm is provided with a notch for abutting against the latching portion of the trough.

7. The pivoting adapter structure according to claim 4, wherein the connector is one of a USB connector, an audio signal terminal connector, a DC plug, a connector for portable electronic products or a video signal terminal connector.

8. The pivoting adapter structure according to claim 4, wherein the plug of the phone line is further provided with a connector for being inserted through by leads of the plug of the phone line, a front portion of the connector is provided with a plurality of line grooves, the leads are inserted through the rear end of the connector and arranged within the line grooves, the connector is engaged and fixed into the plug of the phone line, the connector and the plug of the phone line are combined with each other to form one piece, and the connector is movably pivoted to the connecting unit.

9. A pivoting adapter structure for assembling plugs, comprising:

an insulation case having a trough;

a plurality of terminals disposed in the insulation cases one end of each terminal being disposed in the trough;

a connector disposed on a front end of the insulation case and electrically connected with the other end of the plurality of terminals, a connecting unit movably pivoted in the trough; and a plug of a phone line movably pivoted to the connecting unit and electrically connected with the plurality of terminals;

wherein a rear end of the plug of the phone line is connected with a second connector, and the plug of the phone line is electrically connected with the second connector.

10. The pivoting adapter structure according to claim 9, wherein the second connector is one of an IEEI1394 or a HDMI connector.

* * * * *